US007588422B2

(12) United States Patent
Ochi et al.

(10) Patent No.: US 7,588,422 B2
(45) Date of Patent: Sep. 15, 2009

(54) PUMP DRIVING METHOD AND DEVICE THEREFOR

(75) Inventors: Yoshiyuki Ochi, Settu (JP); Tetsuo Nakata, Kusatsu (JP); Yasuto Yanagida, Kusatsu (JP)

(73) Assignee: Daikin Industries, Ltd., Osaka (JP)

( * ) Notice: Subject to any disclaimer, the term of this patent is extended or adjusted under 35 U.S.C. 154(b) by 367 days.

(21) Appl. No.: 10/534,690

(22) PCT Filed: Nov. 17, 2003

(86) PCT No.: PCT/JP03/14613

§ 371 (c)(1),
(2), (4) Date: Oct. 12, 2005

(87) PCT Pub. No.: WO2004/046552

PCT Pub. Date: Jun. 3, 2004

(65) Prior Publication Data

US 2006/0153689 A1 Jul. 13, 2006

(30) Foreign Application Priority Data

Nov. 15, 2002 (JP) ..... 2002-331569

(51) Int. Cl.
*F04B 49/06* (2006.01)

(52) U.S. Cl. ..... 417/44.11; 417/44.2; 417/12

(58) Field of Classification Search ..... 417/44.1, 417/44.2, 44.11, 45, 18, 12; 318/609, 610, 318/430, 431

See application file for complete search history.

(56) References Cited

U.S. PATENT DOCUMENTS

| | | | | |
|---|---|---|---|---|
| 3,440,508 | A * | 4/1969 | Katsushiro | 318/701 |
| 3,593,103 | A * | 7/1971 | Chandler et al. | 363/174 |
| 4,893,067 | A * | 1/1990 | Bhagwat et al. | 388/823 |
| 6,873,125 | B2 * | 3/2005 | Seima et al. | 318/400.09 |

FOREIGN PATENT DOCUMENTS

| | | | |
|---|---|---|---|
| JP | 60-125794 | A | 7/1985 |
| JP | 1-240781 | A | 9/1989 |
| JP | 9-264260 | A | 10/1997 |
| JP | 2001-342989 | A | 12/2001 |
| WO | WO-99/45276 | A1 | 9/1999 |
| WO | WO-0121959 | * | 3/2001 |

OTHER PUBLICATIONS

Author: Reddy, S. Rama, Title: "Fundamentals of Power Electronics", Published in 2000 by Alpha Science International Ltd., Publisher: CRC Press, Narosa Pub. House, Chapter 9, p. 116, Fig. 9.1—(c).*

* cited by examiner

*Primary Examiner*—Devon C Kramer
*Assistant Examiner*—Dnyanesh Kasture
(74) *Attorney, Agent, or Firm*—Global IP Counselors

(57) ABSTRACT

A pump driving apparatus has a characteristic changing section which receives a set pressure, a set flowing amount, a set horse power, and a DC voltage of the converter section as input, outputs modified values of pressure, flowing amount, and horse power, and supplies the modified values to the horse power command generation section. Therefore, the motor can be driven to suit the change in power voltage so that the motor capacity can be utilized sufficiently.

10 Claims, 6 Drawing Sheets

PUMP DRIVING METHOD AND DEVICE THEREFOR

CROSS-REFERENCE TO RELATED APPLICATIONS

This nonprovisional application claims priority under 35 U.S.C. §119(a) to Japanese Patent Application No. 2002-331569, filed in Japan on Nov. 15, 2002, the entire content of which is hereby incorporated by reference.

TECHNICAL FIELD

The present invention relates to a pump driving method and apparatus thereof which drive a motor based upon a command value using discharge pressure—discharge flow characteristic and carrying out feedback of the discharge pressure, and drive a pump using the motor.

BACKGROUND ART

From the past, a pump driving apparatus is proposed which drives a motor based upon a command value using discharge pressure—discharge flow characteristic and carrying out feedback of the discharge pressure, and drives a pump using the motor.

FIG. 1 is a block diagram illustrating a conventional pump driving apparatus.

The pump driving apparatus comprises a converter section 101, an inverter section 102, a motor 103, and a pump 104.

The converter section 101 receives an alternate current power source as input and generates a direct current voltage.

The inverter section 102 receives the direct current voltage as input and outputs an alternate current voltage.

The motor 103 is supplied the alternate current voltage.

The pump 104 is connected to an output shaft of the motor 103.

The pump driving apparatus also comprises a horse power command generation section 105, a subtraction section 106, a proportional controller 107, an integral controller 108, an integrator 109, an addition section 110, a speed control section 111, and a current control section 112.

The horse power command generation section 105 generates a horse power command based upon discharge pressure—discharge flow characteristic (hereinafter, referred to as P-Q characteristic), a current pressure, and a current flowing amount, the P-Q characteristic being generated, as is illustrated in FIG. 5, by a set pressure, a set flowing amount, and a set horse power defined for a predetermined power voltage.

The subtraction section 106 calculates a difference between the horse power command output from the horse power command generation section 105 and a current horse power.

The proportional controller 107 receives the horse power difference as input, and carries out the proportional control.

The integral controller 108 receives the horse power difference as input, and carries out the integral control.

The integrator 109 integrates the integral control result.

The addition section 110 adds the proportional control result and the integration result so as to obtain a proportion-integration control result (speed command).

The speed control section 111 receives the speed command as input, carries out the speed control operation, and outputs a current command.

The current control section 112 receives the current command and a DC voltage of the converter section 101, carries out the current control operation so as to generate a duty command, and supplies the duty command to the inverter section 102.

The pump driving apparatus further comprises a speed detection section 114, a flowing amount detection section 117, a pressure sensor 115, and a horse power operation section 116.

The speed detection section 114 receives a pulse output from a pulse generator 113 which is connected to the motor 103, and calculates a current speed of the motor 103 based upon a pulse interval.

The flowing amount detection section 117 receives the current speed as input, and calculates a discharge flow by taking a pump volume and the like into consideration.

The pressure sensor 115 detects a current pressure of discharge fluid from the pump 104.

The horse power operation section 116 calculates a current horse power based upon the current flowing amount and the current pressure.

Therefore, adequate pump control can be realized in which the defined P-Q characteristic is determined to be a maximum area.

However, a power voltage is not guaranteed to be kept to a predetermined voltage. A power voltage affects driving, stopping, and the like of adjacent apparatus and the like, and varies accordingly. Therefore, sufficient capacity cannot be realized when a pump is driven using P-Q characteristic which is defined for the predetermined power voltage.

Description is made further.

When a power voltage becomes lower than a predetermined rated voltage, a discharge pressure which is actually possible to be output becomes lower than the discharge pressure ① for the predetermined rated voltage, as is illustrated with ③ in FIG. 2. This P-Q characteristic can be converted to torque—revolution speed characteristic of a motor (refer to FIG. 3). And, ①②③ in FIG. 2 correspond to ①②③ in FIG. 3, respectively. As a result, a condition continues where a current value does not reach for the command value corresponding to the P-Q characteristic illustrated with ①. And, for this time period, the integrator 109 of the P-Q control continues the integration, therefore, the discharge pressure greatly overshoots after the integration result exceeding the constant horse power region (windup phenomenon).

Therefore, in the past, the P-Q characteristic is determined, as is illustrated with ③, for not causing problem in control response even when a power voltage is lowered to some degree. As a result, a disadvantage arises in that a motor capacity cannot be utilized sufficiently.

On the contrary, when the discharge pressure which is actually possible to be output becomes higher than the discharge pressure ① for the predetermined rated voltage, as is illustrated with ② in FIG. 2, the output following the P-Q characteristic illustrated with ② becomes possible. However, a command value only corresponds to the P-Q characteristic illustrated with ①, therefore, a disadvantage arises in that a motor capacity cannot be utilized sufficiently, similarly.

SUMMARY OF THE INVENTION

The present invention was made in view of the above problems.

It is an object of the present invention to provide a pump driving method and apparatus thereof in which a motor capacity cannot be utilized sufficiently following varying in a power voltage.

A pump driving method of a first aspect changes discharge pressure—discharge flow characteristic in correspondence with a power voltage when a motor is driven based upon a command value using discharge pressure—discharge flow characteristic and feedback of the discharge pressure is carried out, and a pump is driven using the motor.

A pump driving method of a second aspect holds discharge pressure—discharge flow characteristics corresponding to a plurality of power voltage, respectively, and selects a corresponding discharge pressure—discharge flow characteristic in correspondence with a detection value in power voltage.

A pump driving method of a third aspect defines a predetermined pressure, flowing amount, and horse power as characteristic values for a predetermined power voltage, and changes a discharge pressure—discharge flow characteristic in correspondence with a detection value in power voltage.

A pump driving method of a fourth aspect judges whether or not a DC voltage of an inverter for supplying a driving voltage to a motor is a ideal DC voltage value of an alternate current power voltage, changes a discharge pressure—discharge flow characteristic for the DC voltage when it is judged that the DC voltage is the ideal DC voltage value of the alternate current power voltage, and maintains the changed discharge pressure—discharge flow characteristic when it is judged that the DC voltage is not the ideal DC voltage value of the alternate current power voltage and when the just prior DC voltage is the ideal DC voltage value of the alternate current power voltage, when a motor is driven based upon a command value using discharge pressure—discharge flow characteristic and feedback of the discharge pressure is carried out, and a pump is driven using the motor.

A pump driving method of a fifth aspect maintains a power voltage value instead of maintaining of the discharge pressure—discharge flow characteristic.

A pump driving apparatus of a sixth aspect drives a motor based upon a command value using discharge pressure—discharge flow characteristic and carries out feedback of the discharge pressure, and drives a pump using the motor, the apparatus comprises characteristic changing means for changing discharge pressure—discharge flow characteristic in correspondence with a power voltage.

A pump driving apparatus of a seventh aspect employs means for holding discharge pressure—discharge flow characteristics corresponding to a plurality of power voltage, respectively, and for selecting a corresponding discharge pressure—discharge flow characteristic in correspondence with a detection value in power voltage, as the characteristic changing means.

A pump driving apparatus of an eighth aspect employs means for defining a predetermined pressure, flowing amount, and horse power as characteristic values for a predetermined power voltage, and for changing a discharge pressure—discharge flow characteristic in correspondence with a detection value in power voltage, as the characteristic changing means.

A pump driving apparatus of a ninth aspect drives a motor based upon a command value using discharge pressure—discharge flow characteristic and carries out feedback of the discharge pressure, and drives a pump using the motor, the apparatus comprises judgment means for judging whether or not a DC voltage of an inverter for supplying a driving voltage to a motor is a ideal DC voltage value of an alternate current power voltage, for changing a discharge pressure—discharge flow characteristic for the DC voltage when it is judged that the DC voltage is the ideal DC voltage value of the alternate current power voltage, and for maintaining the changed discharge pressure—discharge flow characteristic when it is judged that the DC voltage is not the ideal DC voltage value of the alternate current power voltage and when the just prior DC voltage is the ideal DC voltage value of the alternate current power voltage, when a motor is driven based upon a command value using discharge pressure—discharge flow characteristic and feedback of the discharge pressure is carried out, and a pump is driven using the motor.

A pump driving apparatus of a tenth aspect employs means for maintaining a power voltage value instead the maintaining of the discharge pressure—discharge flow characteristic, as the judgment means.

When the pump driving method of a first aspect is employed, the discharge pressure—discharge flow characteristic is changed in correspondence with a power voltage when a motor is driven based upon a command value using discharge pressure—discharge flow characteristic and feedback of the discharge pressure is carried out, and a pump is driven using the motor. Therefore, the motor can be driven to match a value which can be actually output, and the motor capacity can be made the best use of sufficiently.

When the pump driving method of a second aspect is employed, the discharge pressure—discharge flow characteristics corresponding to a plurality of power voltage are held, respectively, and a corresponding discharge pressure—discharge flow characteristic is selected in correspondence with a detection value in power voltage. Therefore, performing of the processing rapidly can be realized, and operation and effect similar to those of the first aspect can be realized.

When the pump driving method of a third aspect is employed, a predetermined pressure, flowing amount, and horse power are defined as characteristic values for a predetermined power voltage, and a discharge pressure—discharge flow characteristic is changed in correspondence with a detection value in power voltage. Therefore, a required memory capacity can be made smaller, and operation and effect similar to those of the first aspect can be realized.

When the pump driving method of a fourth aspect is employed, it is judged whether or not a DC voltage of an inverter for supplying a driving voltage to a motor is a ideal DC voltage value of an alternate current power voltage, a discharge pressure—discharge flow characteristic is changed for the DC voltage when it is judged that the DC voltage is the ideal DC voltage value of the alternate current power voltage, and the changed discharge pressure—discharge flow characteristic is maintained when it is judged that the DC voltage is not the ideal DC voltage value of the alternate current power voltage and when the just prior DC voltage is the ideal DC voltage value of the alternate current power voltage, when a motor is driven based upon a command value using discharge pressure—discharge flow characteristic and feedback of the discharge pressure is carried out, and a pump is driven using the motor. Therefore, instability in transition condition is dissolved, the motor can be driven to match a value which can be actually output, and the motor capacity can be made the best use of sufficiently.

When the pump driving method of a fifth aspect is employed, a power voltage value is maintained instead the maintaining of the discharge pressure—discharge flow characteristic. Therefore, held data amount can be made smaller, and operation and effect similar to those of the fourth aspect can be realized.

When the pump driving apparatus of a sixth aspect is employed, the discharge pressure—discharge flow characteristic is changed in correspondence with a power voltage by the characteristic changing means when a motor is driven based upon a command value using discharge pressure—discharge flow characteristic and feedback of the discharge pressure is carried out, and a pump is driven using the motor.

Therefore, the motor can be driven to match a value which can be actually output, and the motor capacity can be made the best use of sufficiently.

When the pump driving apparatus of a seventh aspect is employed, means for holding discharge pressure—discharge flow characteristics corresponding to a plurality of power voltage, respectively, and for selecting a corresponding discharge pressure—discharge flow characteristic in correspondence with a detection value in power voltage, is employed as the characteristic changing means. Therefore, performing of the processing rapidly can be realized, and operation and effect similar to those of the sixth aspect can be realized.

When the pump driving apparatus of an eighth aspect is employed, means for defining a predetermined pressure, flowing amount, and horse power as characteristic values for a predetermined power voltage, and for changing a discharge pressure—discharge flow characteristic in correspondence with a detection value in power voltage, is employed as the characteristic changing means. Therefore, a required memory capacity can be made smaller, and operation and effect similar to those of the sixth aspect can be realized.

When the pump driving apparatus of a ninth aspect is employed, it is judged whether or not a DC voltage of an inverter for supplying a driving voltage to a motor is a ideal DC voltage value of an alternate current power voltage, a discharge pressure—discharge flow characteristic is changed for the DC voltage when it is judged that the DC voltage is the ideal DC voltage value of the alternate current power voltage, and the changed discharge pressure—discharge flow characteristic is maintained when it is judged that the DC voltage is not the ideal DC voltage value of the alternate current power voltage and when the just prior DC voltage is the ideal DC voltage value of the alternate current power voltage, by the judgment means, when a motor is driven based upon a command value using discharge pressure—discharge flow characteristic and feedback of the discharge pressure is carried out, and a pump is driven using the motor. Therefore, instability in transition condition is dissolved, the motor can be driven to match a value which can be actually output, and the motor capacity can be made the best use of sufficiently.

When the pump driving apparatus of a tenth aspect is employed, means for maintaining a power voltage value instead the maintaining of the discharge pressure—discharge flow characteristic, is employed as the judgment means. Therefore, held data amount can be made smaller, and operation and effect similar to those of the ninth aspect can be realized.

DETAILED DESCRIPTION OF THE PREFERRED EMBODIMENTS

Hereinafter, referring to the attached drawings, we explain embodiments of a pump driving method and apparatus thereof according to the present invention.

Figure 4:
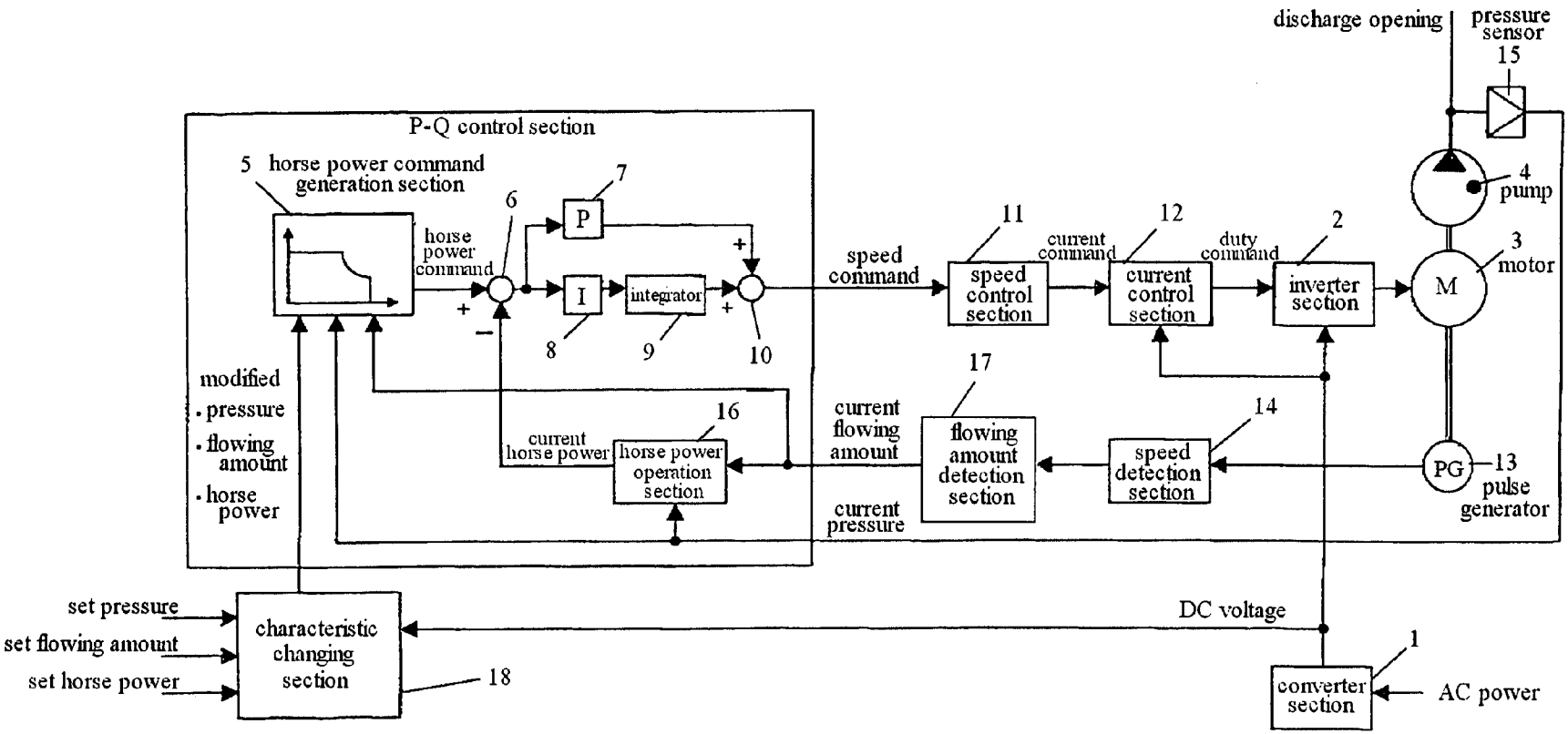
FIG. 4 is a block diagram illustrating a pump driving apparatus of an embodiment according to the present invention.

FIG. 4 is a block diagram illustrating a pump driving apparatus of an embodiment according to the present invention.

Figure 6:
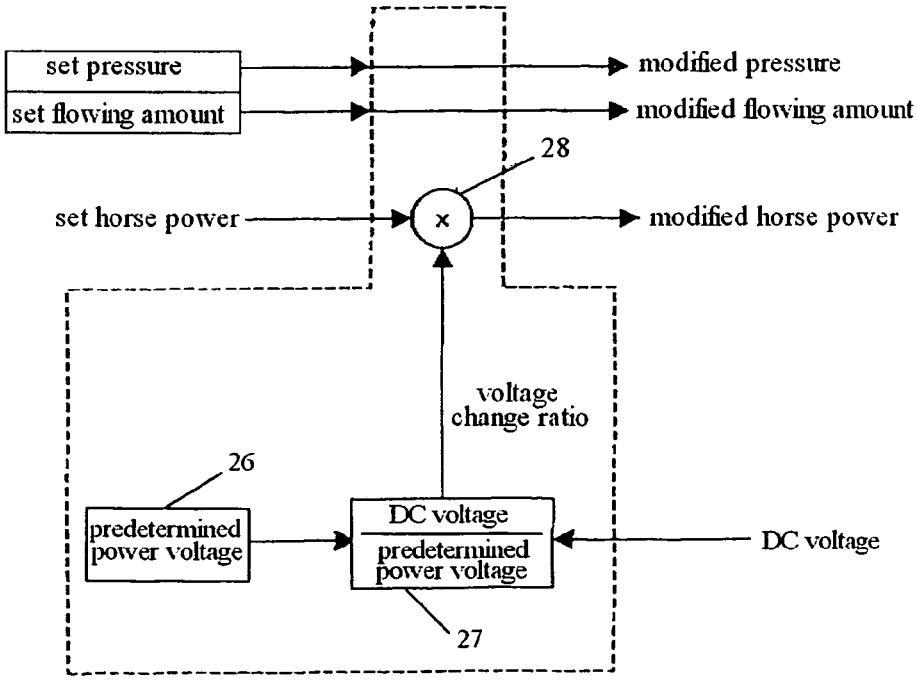
FIG. 6 is a block diagram illustrating a main portion of the pump driving apparatus of the embodiment according to the present invention.

FIG. 6 is a block diagram illustrating a characteristic changing section 18 of FIG. 4 in more detail.

The pump driving apparatus comprises a converter section 1, an inverter section 2, a motor 3, and a pump 4.

The converter section 1 receives an alternate current power source as input and generates a direct current voltage.

The inverter section 2 receives the direct current voltage as input and outputs an alternate current voltage.

The motor 3 is supplied the alternate current voltage.

The pump 4 is connected to an output shaft of the motor 3.

The pump driving apparatus also comprises a characteristic changing section 18, a horse power command generation section 5, a subtraction section 6, a proportional controller 7, an integral controller 8, an integrator 9, an addition section 10, a speed control section 11, and a current control section 12.

The characteristic changing section 18 receives a set pressure, a set flowing amount, a set horse power, and a DC voltage of the converter section 1 as input, outputs modified values of pressure, flowing amount, and horse power, and supplies the modified values to the horse power command generation section 5.

The horse power command generation section 5 calculates a horse power command based upon the modified values of pressure, flowing amount, and horse power, and current pressure, and current flowing amount.

The subtraction section 6 calculates a difference between the horse power command output from the horse power generation section 5 and a current horse power.

The proportional controller 7 receives the horse power difference as input, and carries out the proportional control.

The integral controller 8 receives the horse power difference as input, and carries out the integral control.

The integrator 9 integrates the integral control result.

The addition section 10 adds the proportional control result and the integration result so as to obtain a poroportion-integration control result (speed command).

The speed control section 11 receives the speed command as input, carries out the speed control operation, and outputs a current command.

The current control section 12 receives the current command and a DC voltage of the converter section 1, carries out the current control operation so as to generate a duty command, and supplies the duty command to the inverter section 2.

The pump driving apparatus further comprises a speed detection section 14, a flowing amount detection section 17, a pressure sensor 15, and a horse power operation section 16.

The speed detection section 14 receives a pulse output from a pulse generator 13 which is connected to the motor 3, and calculates a current speed of the motor 3 based upon a pulse interval.

The flowing amount detection section 17 receives the current speed as input, and calculates a discharge flow by taking a pump volume and the like into consideration.

The pressure sensor 15 detects a current pressure of discharge fluid from the pump 4.

The horse power operation section 16 calculates a current horse power based upon the current flowing amount and the current pressure.

The pump driving apparatus further comprises a ratio calculation section 27, and a multiplication section 28.

The ratio calculation section 27 calculates a ratio between a predetermined power voltage 26 and the DC voltage of the converter section 1.

The multiplication section 28 multiplies the operation result (voltage change ratio) calculated by the ratio calculation section 27 to the set horse power so as to generate the modified horse power.

Operation of the pump driving apparatus having the above arrangement is as follows.

Figure 1:
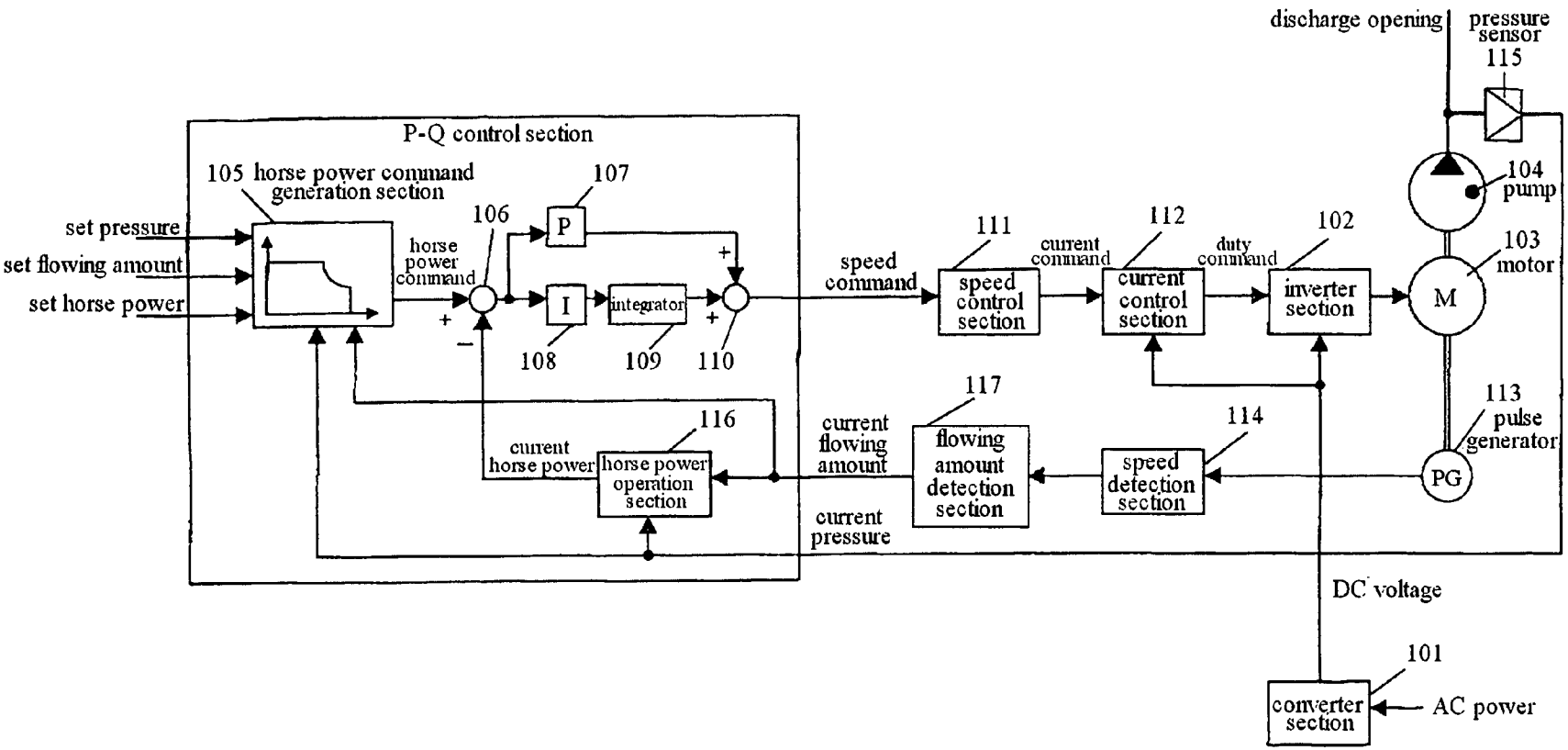
FIG. 1 is a block diagram illustrating a conventional pump driving apparatus.
Figure 2:
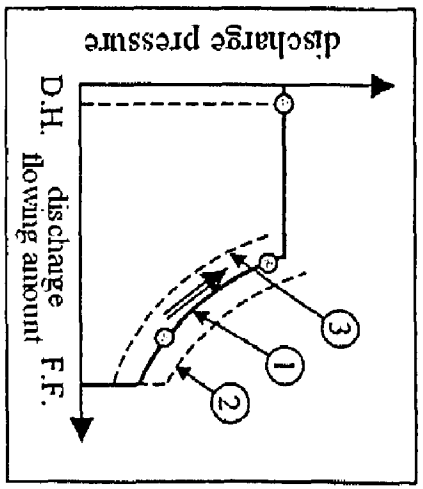
FIG. 2 is a diagram illustrating P-Q characteristic.
Figure 3:
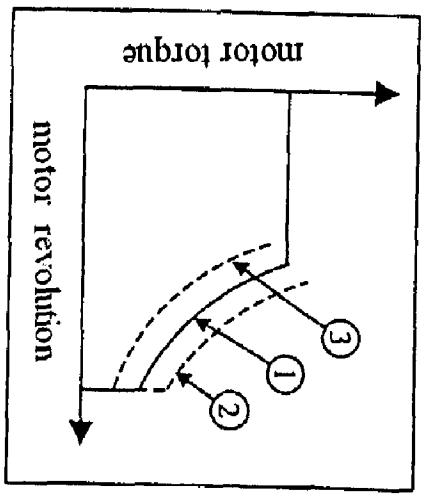
FIG. 3 is a diagram illustrating torque—revolution speed characteristic in correspondence with the P-Q characteristic of FIG. 2.

Operation in a case where the predetermined voltage is equal to the predetermined power voltage is similar to that of the pump driving apparatus in FIG. 1, therefore, description for the case is omitted. Only operation in a case where the power voltage is changed, is described.

When a power voltage is different from the predetermined power voltage, the DC voltage output from the converter section I changes in correspondence with the changing of the power voltage.

The characteristic changing section 18 supplies modified values (pressure, flowing amount, horse power) to the horse power command generation section 5 in correspondence with the DC voltage, even when the set pressure, the set flowing amount, and the set horse power are constant.

As a result, the horse power command generation section 5 generates a horse power command based upon the adequate P-Q characteristic, and the pump 4 is driven based upon the generated horse power command. In other words, the motor can be driven to suit a value which can actually be output so that the motor capacity can be utilized sufficiently.

Figure 5:
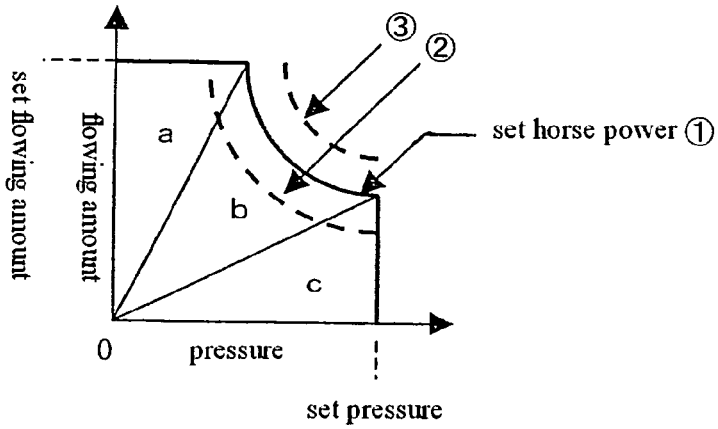
FIG. 5 is a diagram useful in understanding generation of P-Q characteristic.

It is preferable that the horse power command generation section 5 generates characteristic for every region a, b, and c illustrated in FIG. 5, based upon the modified pressure, flowing amount, and horse power.

In the above embodiment, P-Q characteristic is changed using the DC voltage. However, it is possible that P-Q characteristic is changed using an AC power voltage. When AC power is three phase power, it is required to detect power voltages for three phases to deal with the unbalanced supply voltage. Therefore, it is preferable that the DC voltage is used in view of simplification in arrangement, and reduction in cost.

Figure 7:
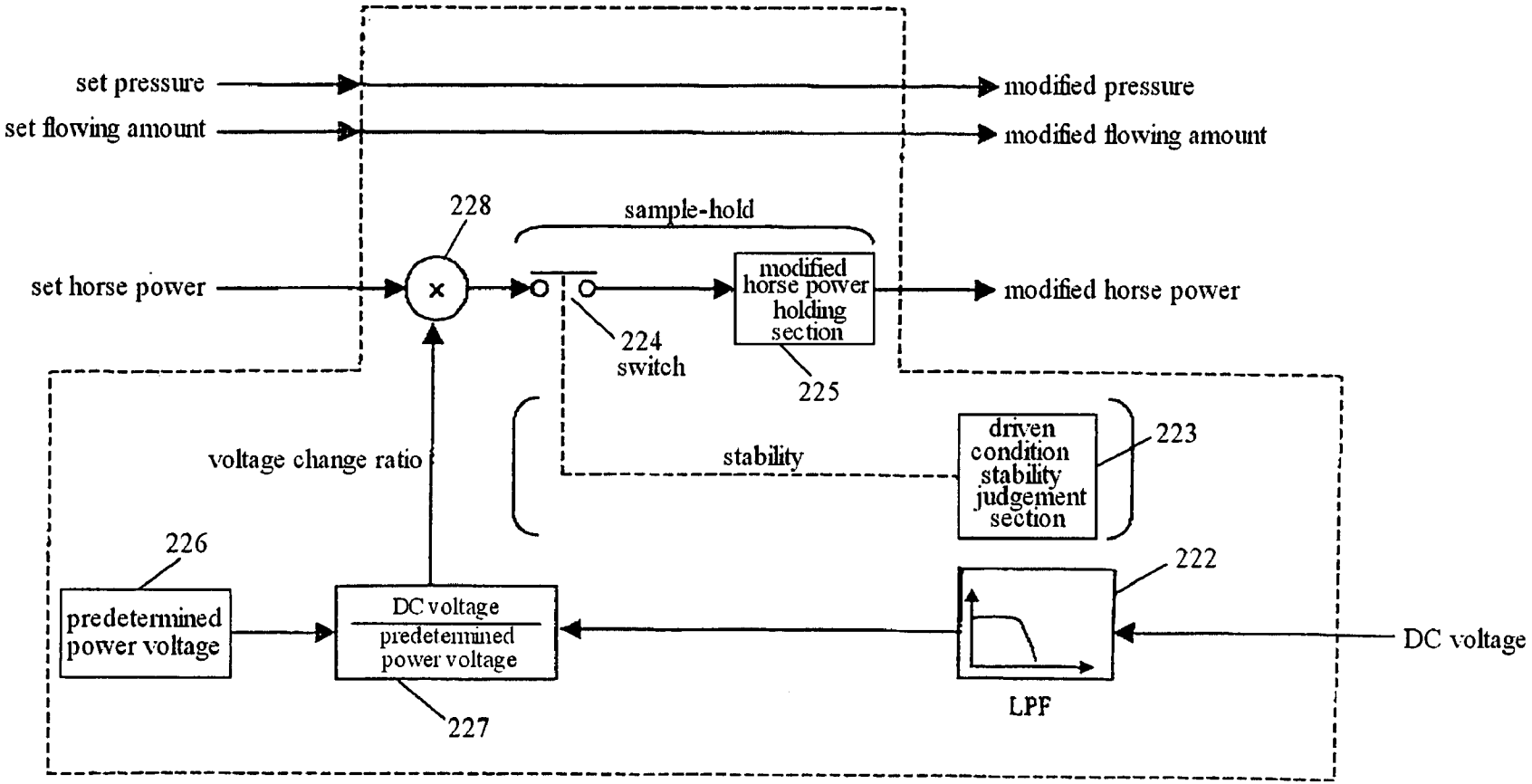
FIG. 7 is a block diagram illustrating a main portion of a pump driving apparatus of another embodiment according to the present invention.

FIG. 7 is a block diagram illustrating a main portion of a characteristic changing section 18 of a pump driving apparatus of another embodiment according to the present invention.

The characteristic changing section in FIG. 7 comprises a low-pass filter 222, a driving condition stability judgment section 223, a ratio calculation section 227, and a multiplication section 228.

The low-pass filter 222 removes high frequency noises and the like included in the input DC voltage.

The driving condition stability judgment section 223 judges whether or not driving condition is stable. The ratio calculation section 227 calculates a ratio between the output voltage from the low-pass filter 222 and the predetermined power voltage output from a predetermined power voltage holding section 226.

The multiplication section 228 multiplies the operation result (voltage change ratio) calculated by the ratio calculation section 227 to the set horse power so as to generate a modified horse power.

A section for judging that driving condition is stable, for example, when a condition is continuing equal to or more than 500 msec, in the condition the motor 3 is driven equal to or less than 2000 rpm and when speed change under the condition is equal to or less than 500 rpm, or when a condition is continuing equal to or more than 500 msec, in the condition the motor 3 is driven equal to or less than 2000 rpm and when speed change under the condition exceeds 500 rpm and when the motor 3 is driven equal to or less than 2000 rpm after 500 msec has passed, is employed as the driving condition stability judgment section 223. However, it is possible to employ other conditions.

When the arrangement in FIG. 7 is employed, only when it is judged that driving condition is stable, a switch 224 is turned on so as to sample-hold the corrected set horse power which is the output value of the multiplication section 228, and to hold the corrected set horse power in a modified horse power holding section 225. When it is judged that driving condition is not stable, the switch 224 is turned off so as to generate a modified horse power which is held by the modified horse power holding section 225.

Therefore, driving of the pump with more stability is realized.

Description is made further.

When the power voltage is detected from the DC voltage, for example, power regeneration may be generated due to deceleration of the motor so that the DC voltage may be raised temporally. When P-Q characteristic is changed by taking the DC voltage into consideration as power voltage change directly for such case, the control condition may become unstable.

However, when the arrangement of FIG. 7 is employed, the motor 3 continues power running for some time period depending upon the motor speed and the degree of power voltage change so that the power is consumed, the power corresponding to the raise due to the power regeneration. The correction of P-Q characteristic is carried out only in a case that the DC voltage is supposed to become the ideal DC voltage value of the AC power voltage (AC voltage$\times 2^{1/2}$). In transient state, the modified horse power is continuously used, the modified horse power being held by the modified horse power holding section 225 prior to becoming transient state. Consequently, the pump 4 can be controlled stably.

By employing a section for judging that driving condition is stable, for example, when a condition is continuing equal to or more than 500 msec, in the condition the motor 3 is driven equal to or less than 2000 rpm and when speed change under the condition is equal to or less than 500 rpm, or when a condition is continuing equal to or more than 500 msec, in the condition the motor 3 is driven equal to or less than 2000 rpm and when speed change under the condition exceeds 500 rpm and when the motor 3 is driven equal to or less than 2000 rpm after 500 msec has passed, as the driving condition stability judgment section 223, it is possible that P-Q characteristic is corrected only in dwelling condition.

When the AC power voltage is directly detected, the above disadvantages and the like are not generated. Therefore, it is not necessary that the arrangement of FIG. 7 is employed.

Figure 8:
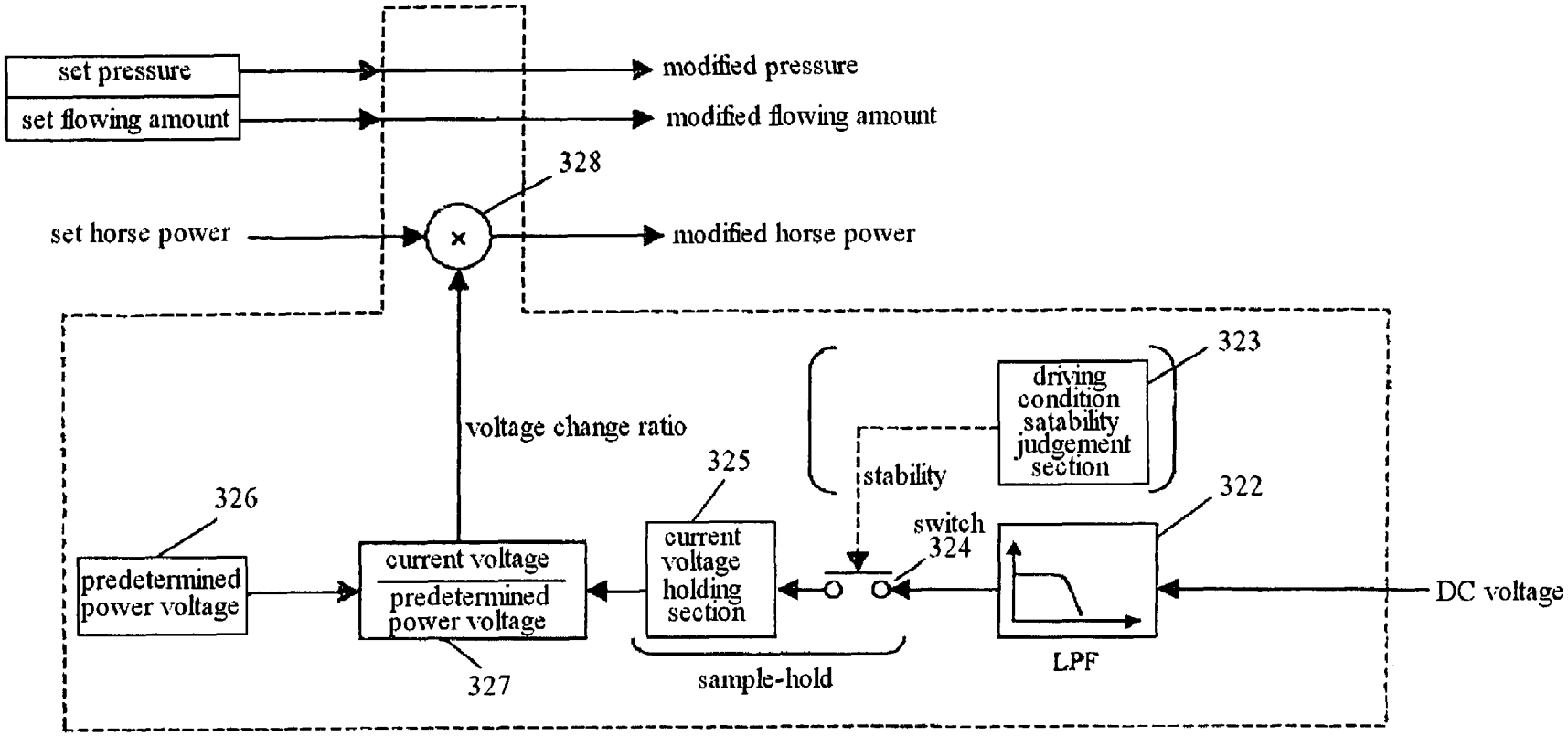
FIG. 8 is a block diagram illustrating a main portion of a pump driving apparatus of a further embodiment according to the present invention.

By allowing the current voltage holding section 325 to hold the output voltage from the low-pass filter 322 by turning the switch 324 on/off using the output of the driving condition stability judgment section 323, as is illustrated in FIG. 8, operation and effect similar to those of FIG. 7 can be realized.

What is claimed is:

1. A pump driving method comprising:

driving a motor based upon a horse power command value using a discharge pressure-discharge flow characteristic;

carrying out feedback control of a discharge pressure;

driving a pump using the motor;

defining a predetermined value of a set horse power as a characteristic value for a predetermined value of a power voltage, the discharge pressure-discharge flow characteristic being represented by a curved line based on the set horse power on pressure axis and flow axis; and changing the curved line with the set horse power that is corresponding to a detected value of the power voltage to change the horse power command value.

2. The pump driving method as set forth in claim 1, further comprising decreasing the command value in correspondence with a decreasing amount of the detected power source voltage when the detected power source voltage decreases.

3. A pump driving method comprising:

driving a motor based upon a command value, carrying out feedback control of a discharge pressure, driving a pump using the motor based on whether or not a detected DC voltage of an inverter for supplying a driving voltage to the motor is an ideal DC voltage value of an alternate current power voltage, changing the command value for the detected DC voltage upon judging that the detected DC voltage is the ideal DC voltage value of the alternate current power voltage, and maintaining the command value last changed during a period in which the detected DC voltage is the ideal DC voltage value upon judging that the detected DC voltage is not the ideal DC voltage value of the alternate current power voltage.

4. The pump driving method as set forth in claim 3, wherein when a condition is continuing for a period equal to or more than first predetermined period of time in which said motor is driven at a rotational speed equal to or less than a first predetermined value and in which rotation speed change of said motor is equal to or less than a second predetermined value, it is judged that the detected DC voltage is the ideal DC voltage value.

5. A pump driving method comprising:

driving a motor based upon a command value, carrying out feedback control of a discharge pressure, driving a pump using the motor based on whether or not a detected DC voltage of an inverter for supplying a driving voltage to the motor is an ideal DC voltage value of an alternate current power voltage, changing the command value for the detected DC voltage upon judging that the detected DC voltage is the ideal DC voltage value of the alternate current power voltage, and maintaining a value of said detected DC voltage used when said command value was last changed during a period in which the detected DC voltage is the ideal DC voltage value upon judging that the detected DC voltage is not the ideal DC voltage value of the alternate current power voltage.

6. A pump driving apparatus comprising:

a motor configured to be driven based upon a horse power command value using discharge pressure-discharge flow characteristic to feedback control a discharge pressure;

a pump operatively coupled to the motor; and a characteristic changing section configured to define a predetermined set horse power as a characteristic value for a predetermined power voltage, the discharge pressure-discharge flow characteristic being represented by a curved line based on the set horse power on pressure axis and flow axis, the characteristic changing section being further configured to change the curved line with the set horse power that is corresponding to a detected value of the power voltage to change the horse power command value.

7. The pump driving apparatus as set forth in claim 6, wherein the characteristic changing section is configured to decrease the command value in correspondence with a decreasing amount of the detected power source voltage when the detected power source voltage decreases.

8. A pump driving apparatus comprising:

a motor configured to be driven based upon a command value to feedback control a discharge pressure, a pump operatively coupled to the motor, and judgment section configured to judge whether or not a detected DC voltage of an inverter for supplying a driving voltage to a the motor is an ideal DC voltage value of an alternate current power voltage, configured to change the command value for the detected DC voltage upon judging that the detected DC voltage is the ideal DC voltage value of the alternate current power voltage, and configured to maintain the command value last changed during a period in which the detected DC voltage is the ideal DC voltage value upon judging that the detected DC voltage is not the ideal DC voltage value of the alternate current power voltage.

9. The pump driving apparatus as set forth in claim 8, wherein when a condition is continuing for a period equal to or more than first predetermined period of time in which said motor is driven at a rotational speed equal to or less than a first predetermined value and in which rotation speed change of said motor is equal to or less than a second predetermined value, said judgment section judges that the detected DC voltage is the ideal DC voltage.

10. A pump driving apparatus comprising:

a motor configured to be driven based upon a command value to feedback control a discharge pressure, a pump operatively coupled to the motor, and judgment section configured to judge whether or not a detected DC voltage of an inverter for supplying a driving voltage to the motor is an ideal DC voltage value of an alternate current power voltage, configured to change the command value for the detected DC voltage upon judging that the detected DC voltage is the ideal DC voltage value of the alternate current power voltage and configured to maintain a value of said detected DC voltage used when said command value was last changed during a period in which the detected DC voltage is the ideal DC voltage value upon judging that the detected DC voltage is not the ideal DC voltage value of the alternate current power voltage.

* * * * *